US008091976B2

(12) United States Patent
Terashima et al.

(10) Patent No.: US 8,091,976 B2
(45) Date of Patent: Jan. 10, 2012

(54) INKJET PRINTING APPARATUS AND METHOD OF PREDICTING

(75) Inventors: Hideyuki Terashima, Kawasaki (JP); Yuji Hamasaki, Kawasaki (JP); Hirokazu Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 12/403,793

(22) Filed: Mar. 13, 2009

(65) Prior Publication Data

US 2009/0231380 A1 Sep. 17, 2009

(30) Foreign Application Priority Data

Mar. 14, 2008 (JP) ..... 2008-066476

(51) Int. Cl.
*B41J 29/38* (2006.01)

(52) U.S. Cl. ..... 347/14; 347/17; 347/9

(58) Field of Classification Search ..... 347/5, 7, 347/9, 14, 17, 19
See application file for complete search history.

(56) References Cited

U.S. PATENT DOCUMENTS

| | | | | |
|---|---|---|---|---|
| 5,734,391 | A | 3/1998 | Tanaka et al. | 347/14 |
| 6,086,180 | A | 7/2000 | Sugimoto et al. | |
| 6,193,351 | B1 | 2/2001 | Yaegashi et al. | 347/23 |
| 6,305,776 | B1 * | 10/2001 | Ohshima et al. | 347/17 |
| 6,406,113 | B1 * | 6/2002 | Kato | 347/14 |
| 2007/0285467 | A1 | 12/2007 | Tanaka et al. | 347/60 |
| 2008/0143809 | A1 | 6/2008 | Tanaka et al. | 347/194 |
| 2008/0165217 | A1 | 7/2008 | Tanaka et al. | 347/17 |
| 2009/0244161 | A1 | 10/2009 | Yamamoto et al. | 347/17 |

FOREIGN PATENT DOCUMENTS

JP 06-336024 12/1994

* cited by examiner

*Primary Examiner* — Lam S Nguyen

(74) *Attorney, Agent, or Firm* — Fitzpatrick, Cella, Harper & Scinto

(57) ABSTRACT

There are provided an inkjet printing apparatus and a method of predicting which can perform an accurate ink remaining amount detection. An inkjet printing apparatus is for performing printing onto a print medium by using a print head including an energy generating element generating energy used for ejecting ink from an ejection opening. The apparatus has a print head temperature detecting unit, an atmosphere temperature detecting unit and a predicting unit. The predicting unit drives the energy generating element at the time a difference between the temperature of the print head before driving the energy generating element and the atmosphere temperature detected by the atmosphere temperature detecting unit is less than a predetermined temperature.

4 Claims, 11 Drawing Sheets

DELETION NEW PAGE
NEW PAGE
NEW PAGE
NEW PAGE
NEW PAGE

INKJET PRINTING APPARATUS AND METHOD OF PREDICTING

BACKGROUND OF THE INVENTION

1. Field of the Invention

The present invention relates to an inkjet printing apparatus and a predicting method of predicting an ejecting state of ink of a print head.

2. Description of the Related Art

In recent years, in a printing apparatus such as a printer, a copying machine, a facsimile device or the like, an inkjet system capable of ejecting a minute ink droplet with a high frequency becomes widely used. Among others, a printing apparatus of a thermal inkjet printing system for ejecting ink by using bubbles generated by driving a heater (electrothermal converter or energy generating element) can form highly concentrated nozzles to print an image in a highly fine quality.

The inkjet printing apparatus is generally used in such a manner that an ink tank filled with ink is mounted and when the ink tank becomes empty by printing, the ink tank is replaced. Some of this type of printing apparatuses, for preventing ink from running out during printing, have a function of informing a user whether or not the ink runs out by detecting an ink remaining amount before printing. Particularly, in the equipment where print data such as facsimiles are not left in a user's side, a high detection accuracy of the ink remaining amount is required for preventing empty printing that the ink is not ejected due to the running-out of ink.

As a method of determining an ink remaining amount, there is known a method of detecting an ink remaining amount based upon an ink use amount obtained by counting the number of the times of ink ejections from a point where an ink tank is not used or a method of detecting an ink remaining amount by emitting light on an optical transmission portion of an ink tank.

Moreover, there is known a method of determining an ink remaining amount by detecting a change in print head temperature before and after driving a heater. In a case of driving the heater in a state where ink exists sufficiently in an ink tank, since the ink heated by the heater foams and ejects to consume the energy, heat is not relatively stored in the print head. On the other hand, in a state where the ink tank is empty due to non-existence of the ink, since the heat generated by driving the heater all is stored in the print head, a temperature in the print head is high. In a method of determining an ink remaining amount by detecting a temperature change of the print head, the ink remaining amount is determined using such a phenomenon. Since in this method, it is determined whether or not the ink is actually ejected, an accuracy of detecting a remaining amount immediately before the ink runs out is high.

In a technology disclosed in Japanese Patent Laid-Open No. H06-336024(1994), a monitor value of the print head temperature is compared with a prediction value of a print head temperature led from energy inputted to the print head, and presence/absence of ink is determined by comparing the above comparison result with a predetermined threshold value. With use of this method, the heater drive can be stopped in a point where the ink ejection can not be carried out from all nozzles from a point where the ink ejection is started. Therefore, the ink is not wastefully consumed unlike a case of driving the heater in a predetermined time. Further, since an empty ejection of continuing to drive the heater in a state where the ink runs out is not also carried out, the print head does not have a temperature higher than necessary. Therefore, the print head endurance also improves.

The print head temperature, however, changes with a head temperature immediately before driving the heater, an atmosphere temperature at that time or the like. Accordingly, in a case of detecting an ink remaining amount immediately after the completing printing, an accurate temperature of the print head can not be possibly detected due to a rise of the head temperature by the printing. That is, the print head temperature detection at the time of detecting the ink remaining amount results in being performed in a state where the print head temperature is unstable, and therefore, the monitor value and the prediction value of the print head temperature may not be obtained accurately and stably.

SUMMARY OF THE INVENTION

The present invention is made in view of the foregoing issue and an object of the present invention is to provide an inkjet printing apparatus and a method of predicting which can perform predicting an ejecting state of ink of a print head even in a case where a temperature of a print head rises due to printing.

According to the present invention for achieving the above object, an inkjet printing apparatus for performing printing onto a print medium by using a print head including an energy generating element generating energy used for ejecting ink from an ejection opening comprising: a print head temperature detecting unit that detects a temperature of the print head; an atmosphere temperature detecting unit that detects an atmosphere temperature of the printing apparatus; and a predicting unit that drives the energy generating element after performing the printing onto the print medium and detects temperatures of the print head before and after driving the energy generating element by the print head temperature detecting unit to predict whether or not the print head is in a state of being capable of ejecting the ink, wherein the predicting unit drives the energy generating element at the time a difference between the temperature of the print head before driving the energy generating element and the atmosphere temperature detected by the atmosphere temperature detecting unit is less than a predetermined temperature.

According to the above construction, the ink remaining amount detection can be performed after the print head is reduced to a constant temperature. In consequence, even if a temperature of the print head rises by the printing, an accurate ink remaining amount detection can be performed.

Further features of the present invention will become apparent from the following description of exemplary embodiments (with reference to the attached drawings).

DESCRIPTION OF THE EMBODIMENTS

Hereinafter, an embodiment in the present invention will be in detail explained with reference to the drawings.

Figure 1A:
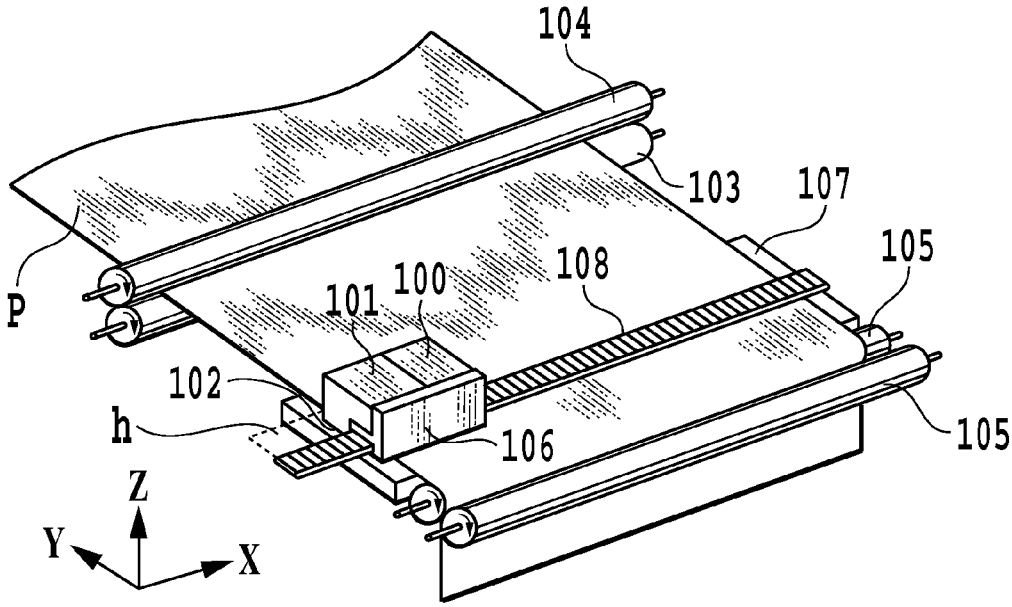
FIG. 1A and FIG. 1B are diagrams each showing a schematic construction of a printing apparatus in which an inkjet print head is mounted in an embodiment of the present invention.
Figure 1B:
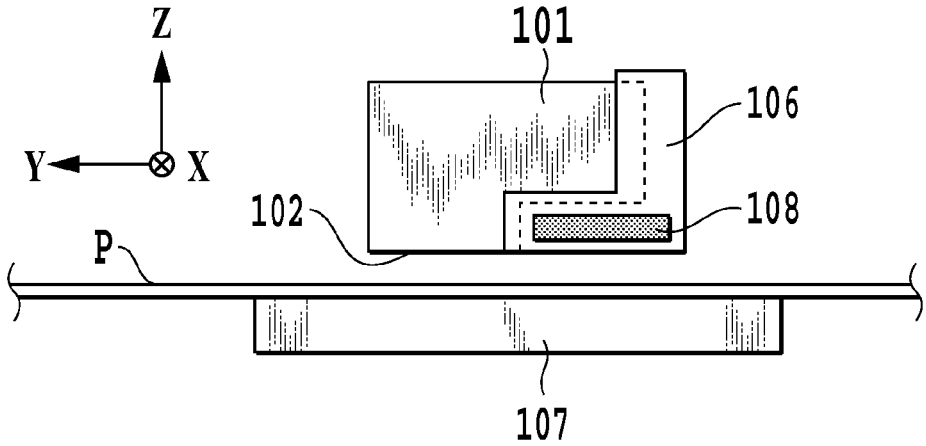

FIGS. 1A and 1B are diagrams each showing a schematic construction of a printing apparatus in the embodiment of the present invention. FIG. 1A shows a perspective view of the printing apparatus in the embodiment of the present invention. FIG. 1B is a cross section taken along Y-Z in a print head portion in FIG. 1A.

Print heads 100 and 101 are print heads configured integrally with an ink tank. It should be noted that the print head united with the ink tank is used in the present embodiment, but in the present invention, the ink tank may be separated from the print head.

Black ink, light cyan ink, and light magenta ink are accommodated in the ink tank of the print head 100. Cyan ink, magenta ink, and yellow ink are accommodated in the ink tank of the print head 101. The print heads 100 and 101 have the same construction other than the ink to be accommodated. Further, the print heads 100 and 101 are provided with plural ejection openings arranged to correspond to respective colors of ink.

A conveying roller 103 and an auxiliary roller 104 rotate in a direction of an arrow in the figure while holding a print medium P in cooperation and conveying the print medium P in a Y direction as needed. Paper feeding rollers 105 convey the print medium P and also act to hold the print medium P in the same way as the conveying roller 103 and the auxiliary roller 104. In addition, a platen 107 serves to stably support the print medium P in a print position. Here, the print medium means not only a paper used in a general printing apparatus, but also an ink receptible material, broadly including cloth, plastic films, metallic plates, glass, ceramics, lumber, leather and the like.

A carriage 106 supports the print heads 100 and 101 and moves the print heads 100 and 101 along a carriage belt 108. The carriage 106, at the time of not performing the printing or at the time of a recovery operation of the print head, waits in a home position h of a position shown in a broken line in the figure. The carriage 106 is provided with an atmosphere temperature sensor mounted thereon which is atmosphere temperature detecting means for measuring an atmosphere temperature in the surroundings of the print head.

The printing apparatus of the present embodiment is to perform the printing onto the print medium with repetition of transfer of the carriage 106 in a main scan direction and transfer of the print medium in a sub scan direction. It should be noted that "printing" means not only forming meaningful information such as characters and graphics, but also may mean forming non-meaningful information. Moreover, "printing", whether or not elicited in such a manner as to be capable of being visually perceived by people, broadly includes forming an image, a design, a pattern, and the like on the print medium and also processing the medium.

FIG. 2A to FIG. 2D are diagrams each showing the construction of the print head. It should be noted that "nozzle" is collectively referred to as an ejection opening or a liquid passage communicated with the ejection opening, and an element generating energy used for ink ejection. Since the print heads 100 and 101 have the same construction, here the construction of the print head 101 will be explained. Further, the print head 101 in the present embodiment is provided with an ink tank into which ink of cyan, magenta and yellow is injected, but the present invention is limited to such an ink tank. That is, the present invention includes an ink tank accommodating a liquid provided for forming an image, a design, a pattern and the like or processing a print medium by being applied on a print medium, or treating ink (for example, solidification or encapsulation of a color material in ink applied in the print medium).

Figure 2A:
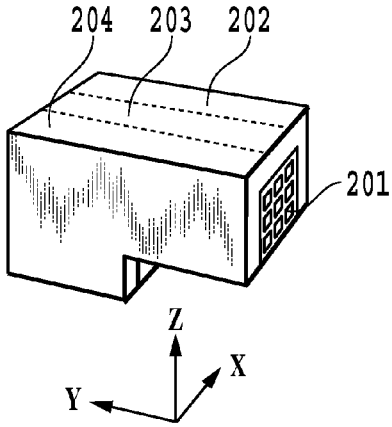
FIG. 2A to FIG. 2D are diagrams each showing a construction of the print head in the embodiment of the present invention.

FIG. 2A is a perspective view showing the print head 101. The print head in the present embodiment receives a print signal through a contact pad 201 from the printing apparatus body and power required for driving the print head is supplied. In addition, cyan ink, magenta ink and yellow ink are injected respectively by 10 g into ink tank chambers 202, 203 and 204 partitioned by print head internal walls shown in broken lines. The ink tank chambers 202, 203 and 204 have the same in structure and the like.

Figure 2B:
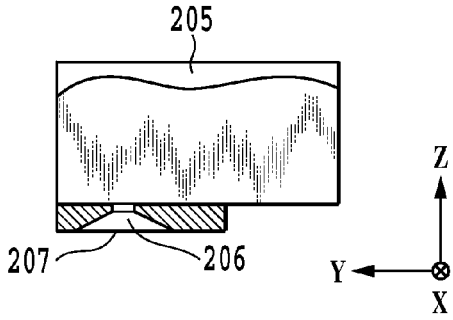

FIG. 2B is a cross sectional view showing a cross section of the cyan ink tank chamber 202 at the time of viewing the print head in a X direction. The ink held by an ink absorption element 205 (shown in gray color in the figure) is supplied through an ink flow passage 206 to a print head chip 207.

Figure 2C:
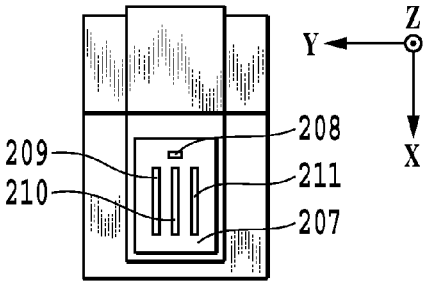

FIG. 2C is a bottom view at the time of viewing the print head in a Z direction. The print head chip 207 is provided with a diode sensor 208 for detecting a temperature of a print head substrate. This diode sensor 108 detects the temperature of the print head substrate (hereinafter, refer to a print head temperature) and outputs the detected temperature to the printing apparatus body. An element of the print head temperature detecting means may include a metallic film sensor or the like other than the diode sensor. Further, an ejection opening array 209 for ejecting cyan ink, an ejection opening array 210 for ejecting magenta ink, and an ejection opening array 211 are arranged in the print head chip 207.

Figure 2D:
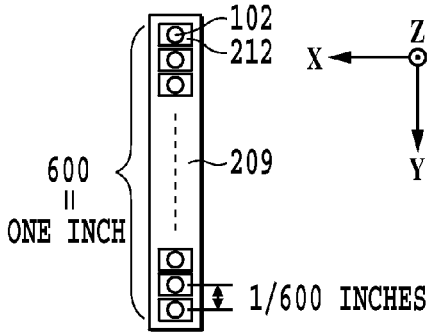

FIG. 2D is an exploded view showing the ejection opening array 209 for ejecting cyan ink in FIG. 2C. The ejection openings 102 are arranged on the cyan ejection opening array 209, and the heater 212 as the energy generating element which generates bubbles to eject ink is provided under (in a Z direction side) each ejection opening 102. The print head of the present embodiment is configured in such a manner that the number of the ejection openings 102 arranged on the cyan ejection opening array 209 is 600 pieces, a clearance between the ejection openings 102 is 1/600 inches, and the print pixel density is 600 dpi. In addition, the print head is configured so that an ink droplet having about 2 pl per one droplet can be ejected from the ejection opening 102. The maximum ejection frequency of the heater 212 for ejecting this ink droplet is 20 kHz, but the maximum ejection frequency suitable for printing is 10 kHz. A speed of a carriage in a main scan direction (X axis direction) mounting the print heads 100 and 101 is 8.33 inches/sec found by dividing 10000 (dot/sec) by 12 (dot/inch) when the ink droplets are printed by a clearance of 1200 dpi in a main scan direction.

Figure 3:
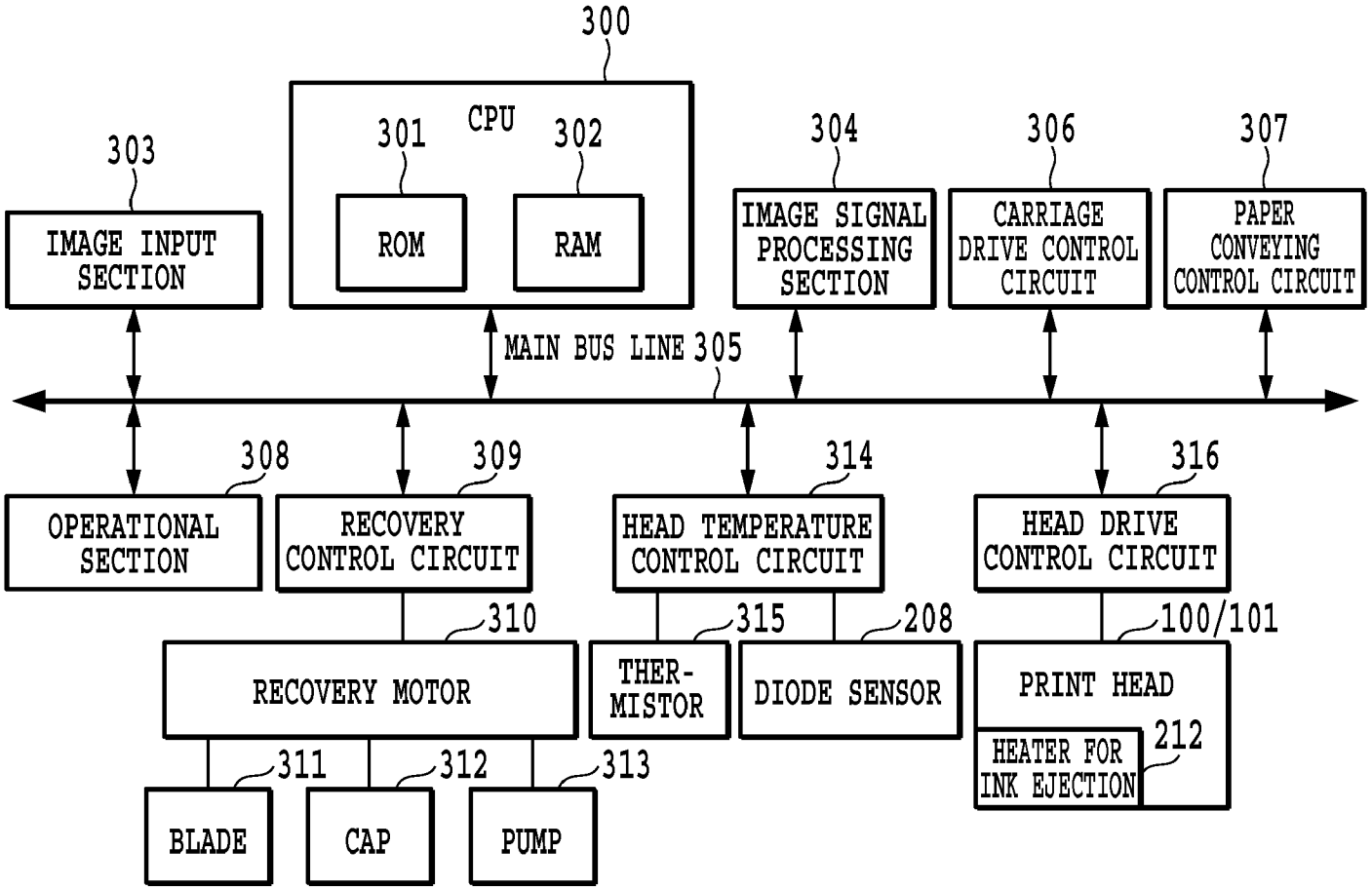
FIG. 3 is a block diagram showing a control construction of the printing apparatus in the embodiment of the present invention.

FIG. 3 is a block diagram showing the control construction of the printing apparatus in the present embodiment. The respective elements in the present control construction are largely classified into software controlling means and hardware processing means. The software controlling means includes processing means such as an image input section 303, an image signal processing section 304 corresponding thereto, a central processor unit CPU 300 and the like each having access to a main bus line 305. In addition, the hardware processing means includes processing means such as an operation section 308, a recovery control circuit 309, a head temperature control circuit 314, a head drive control circuit 316, a carriage drive control circuit 306 in a main scan direction, a paper conveying control circuit 307 in a sub scan direction and the like. The CPU 300 usually includes a ROM 301 and a RAM 302 and provides an appropriate condition to input information to drive the heater 212 for ink ejection in the print heads 100 and 101 for the printing. Further, a program is in advance stored in the RAM 302 for executing a recovery timing chart in the print head and provides a recovery condition such as a preliminary ejection condition to the recovery control circuit 309, the print heads 100 and 101 and the like as needed. The image input section 303 receives image data, commands, status signals and the like from an external device (host device) connected to the printing apparatus. A recovery motor 310 drives the print heads 100 and 101, a cleaning blade 311 positioned to be spaced from and be opposed to them, a cap 312, and a suction pump 313. The head drive control circuit 316 drives the heater 212 on the print heads 100 and 101 based upon output values of a thermistor 315 for detecting a peripheral temperature of the printing apparatus and the diode sensor 208 for detecting a print head temperature. In addition, the print heads 100 and 101 carry out preliminary ejection, ink ejection and an ink temperature adjustment for a temperature keeping control.

Upon driving the heater 212, a print signal (DATA), a clock signal (CLK) for transferring the print signal, a drive signal (HE) for driving the heater, and a latch signal (LT) for latching the print signal to a holding circuit are inputted to the print heads 100 and 101 from the printing apparatus.

Figure 4A:
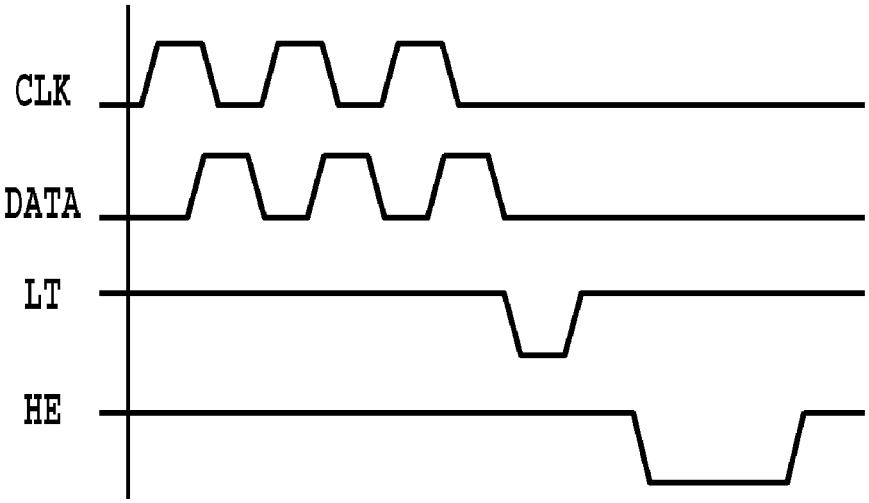
FIG. 4A and FIG. 4B are a time chart and a block diagram at the time of driving a heater in the embodiment of the present invention.
Figure 4B:
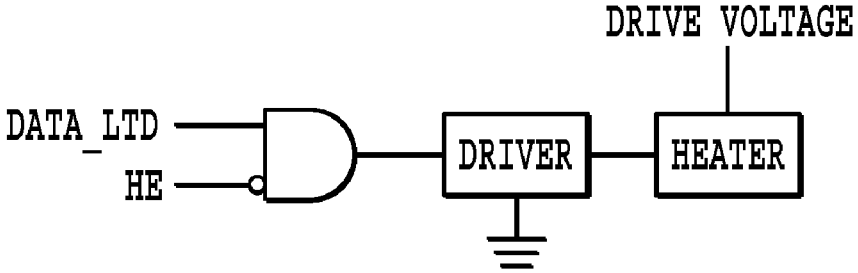

FIG. 4A is a timing chart at the time of driving the heater 212 and FIG. 4B is a block diagram showing a drive of the heater. A print signal (DATA) is inputted in synchronization with a clock signal (CLK) and a latch signal is inputted to fix a print signal (DATA_LTD). When a drive signal (HE) is inputted after that, a drive voltage is applied to the heater selected by a driver to eject ink. The latch signal (LT) and the drive signal (HE) are non-signals, that is, in high levels until the input of the print signal (DATA) is completed. In addition, the print signal (DATA) is in synchronization with the clock signal (CLK). When the print heads 100 and 101 each having 600 pieces as the nozzle number of each array are driven in 10 kHz, the clock signal frequency is 10 kHz×600=6 MHz. Since the high frequency signal such as the clock signal (CLK) or the print signal DATA) thus exists, electrical noises are generated in the print heads 100 and 101 and in consequence, the noise is added in the diode output value outputted from the print head to the printing apparatus.

Figure 5:
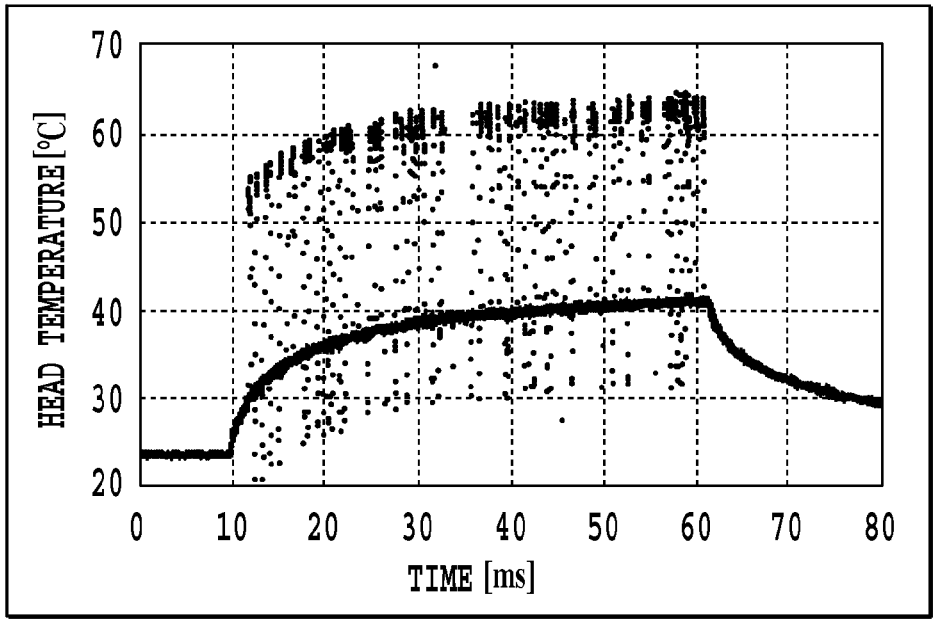
FIG. 5 is a graph showing a time change of a diode sensor at the time of driving the heater in the embodiment of the present invention.

FIG. 5 is a graph showing a time change of the diode sensor at the time of driving the heater 212. This figure shows the time change of output values of the diode sensor 208 at the time of driving the heater 212 in such a manner that all nozzles in the cyan ink array of the print head 101 eject 2000 times in 5 kHz. The heater drive starts at a point of 10 ms and terminates at a point of 60 ms. It is found out that, as compared to the timing before starting the heater drive or the timing after terminating it, the noise is largely added in the output value of the diode sensor 208 during the driving of the heater. In this way, based upon the output value of the diode sensor detected during the driving of the heater, it is difficult to obtain an accurate print head temperature.

Next, a method of predicting an ink remaining amount in the present embodiment will be explained.

First, for storing the result of a rise in print head temperature due to ink ejection executed when ink certainly exists, control for obtaining a print head temperature characteristic is performed when a new print head 101 is mounted. The control for obtaining the print head temperature characteristic may be performed in a state where an ink amount much more than an ink amount consumed by the control itself exists. Therefore, in the present embodiment, the control is performed at the time of mounting a new product, but in a case where the print head has a storage region holding ink remaining amount information and can recognize an ink remaining amount in a certain degree, the control may be performed at timing when a state where the ink certainly exists is satisfied.

Figure 6:
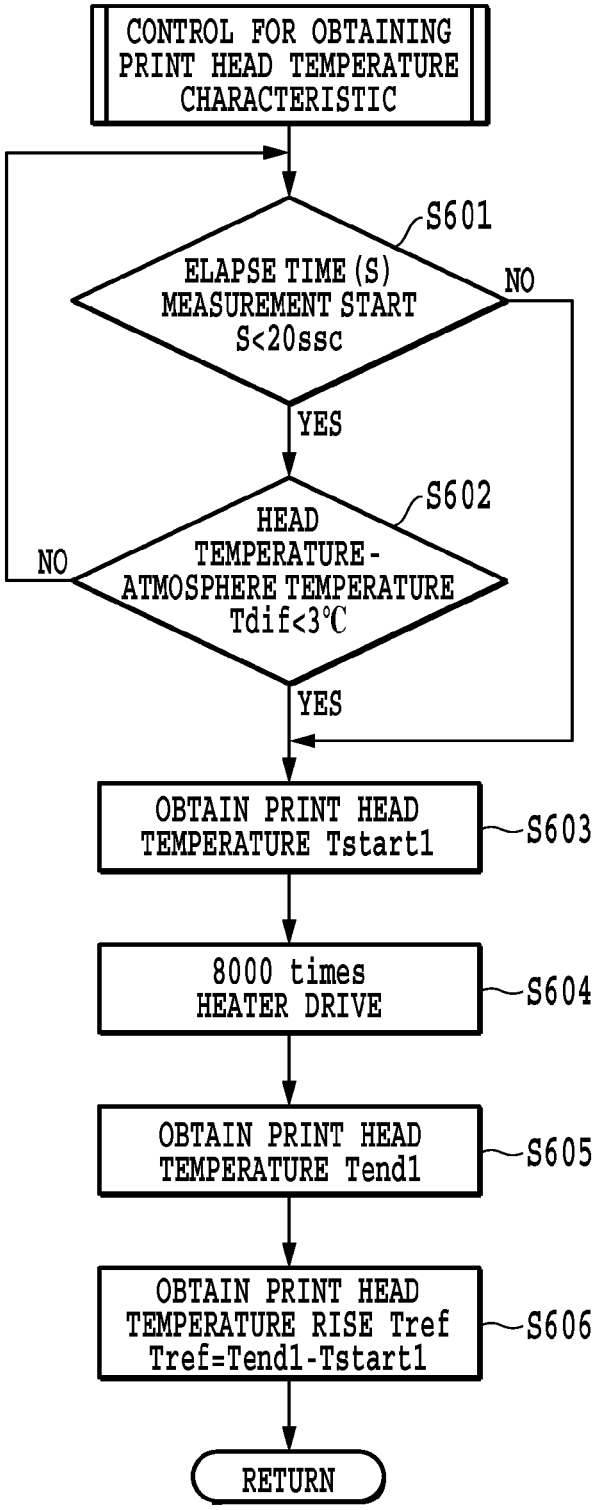
FIG. 6 is a flow chart showing a detail of control for obtaining a print head temperature characteristic in the embodiment of the present invention.

FIG. 6 is a flow chart showing the control for obtaining the print head temperature characteristic. First, an elapse time from a point of starting this control is measured. It is determined whether or not the elapse time is less than 20 sec (S601). In a case where the elapse time is 20 sec or more, the process goes to step S603. In a case where the elapse time is less than 20 sec, a difference Tdif between an atmosphere temperature measured by the atmosphere temperature sensor as the atmosphere temperature detecting means mounted in the carriage and a head temperature measured by the print head temperature detecting means is calculated (S602). In a case where the difference Tdif between the atmosphere temperature and the head temperature is a predetermined temperature or more, the process goes back to step S601. On the other hand, in a case where the difference Tdif between the atmosphere temperature and the head temperature is less than the predetermined temperature, the process goes to step S603. In the present embodiment, the predetermined temperature is 3° C.

That is, in a case where the elapse time is 20 sec or more or in a case where the difference Tdif between the atmosphere temperature and the head temperature is less than 3° C., the process goes to step S603.

Next, a print head temperature Tstart1 before driving the heater is obtained (S603). Further, the heater (energy generating element) is driven for ejecting ink 8000 times in 15 kHz from all nozzles ejecting cyan ink of the print head 101 (S604) to obtain a head temperature Tend1 after 8000 times of the ejections (S605).

Finally, a temperature rise Tref=Tend1−Tstart1 due to the heater drive corresponding to 8000 times of the ejections is stored in the RAM region (S606).

Figure 7:
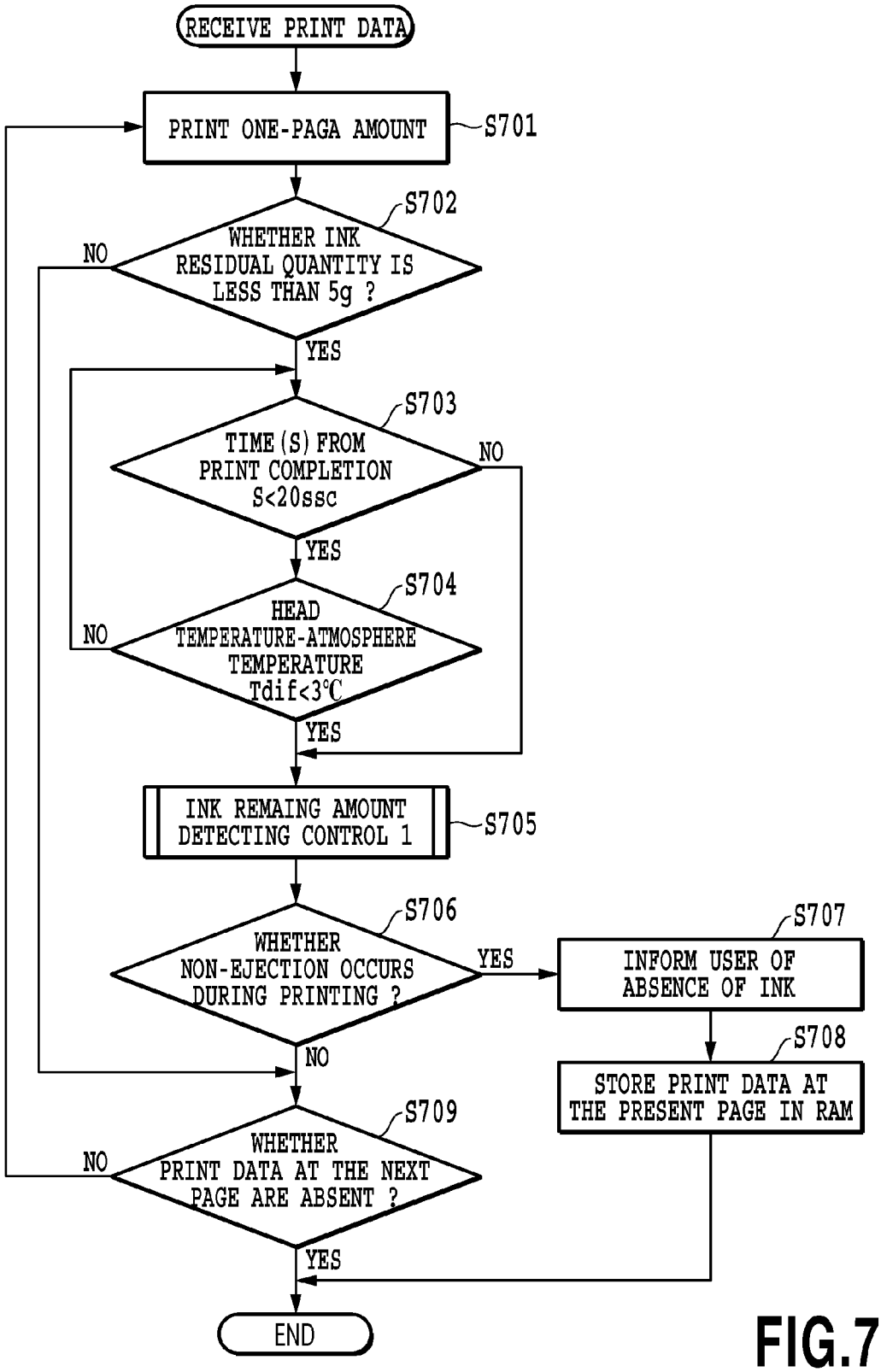
FIG. 7 is a flow chart showing an outline of the print operation in the embodiment of the present invention.

FIG. 7 is a flow chart showing an outline of a print operation in the present embodiment. Here, a case of the print head 101 using cyan ink will be explained as a representative and the print head 101 is also the same.

When the printing apparatus in the present embodiment receives print data, the printing corresponding to one page is carried out (S701). Subsequently, it is determined whether or not the ink remaining amount exists on some level (S702). The determination herein does not require so much high accuracy and therefore, an ink consumption amount is calculated by the number of the ink ejection times to determine whether or not the ink remaining amount is less than a certain amount. In the present embodiment, this certain amount is set as 5 g considering a amount having some degree of margins in addition to the ink remaining amount to be capable of performing the printing of the next page without shortage or obscuration of ink in the halfway regardless of any print pattern. In a case where the ink remaining amount is 5 g or more, it is determined whether or not print data at the next page exist (S709). When the print data do not exist, the process ends. When the print data exist, an ink remaining amount is calculated from the ink consumption in accordance with the number of the ink ejection times used for the printing at the previous page, and thereafter, the process goes to S701, wherein the printing is carried out again.

At step S702, in a case where the ink remaining amount is less than 5 g, an elapse time from completion of the printing corresponding to one page is calculated (S703). In a case where the elapse time from completion of the printing corresponding to one page is less than 20 sec, a difference Tdif between an atmosphere temperature Tenv measured by the atmosphere temperature sensor mounted in the carriage and a head temperature Thead (Tdif=Thead−Tenv) is compared (S704). In a case where the Tdif is a predetermined temperature or more, the process goes back to S703. In a case where the Tdif is less than the predetermined temperature, the process goes to Step S705, wherein an ink remaining amount detecting control 1 is performed. In the present embodiment, the predetermined temperature is 3° C.

On the other hand, in a case where the elapse time from completion of the printing corresponding to one page is not 20 sec or more, the difference Tdif between the atmosphere temperature Tenv and the head temperature Thead (Tdif=Thead−Tenv) is not compared S704) and the ink remaining amount detecting control 1 is performed (S705).

That is, in a case where the difference between the atmosphere temperature and the head temperature is less than 3° C. at S704 or the elapse time from completion of the printing is 20 sec or more at S703, the process goes to the ink remaining amount detection control 1.

Next, the ink remaining amount detecting control 1 will be in detail explained. The ink remaining amount detecting control 1 in the present embodiment stores the result of a rise in print head temperature due to the ink ejection executed at the time the ink certainly exists, and compares the print head temperature at the time of detecting the ink remaining amount with the stored result of the rise in print head temperature. In addition, when the difference between the print head temperature at the time of detecting the ink remaining amount and the stored result of the rise in print head temperature is within a certain range, it is determined that non-ejection does not occur, and in a case where the difference is more than the certain range, it is detected that the non-ejection occurs. The ink remaining amount detecting control 1 in the present embodiment predicts the non-ejection occurs, but in the present invention, it is predicted by comparing multiple threshold value to result of the rise in print head temperature.

Figure 8:
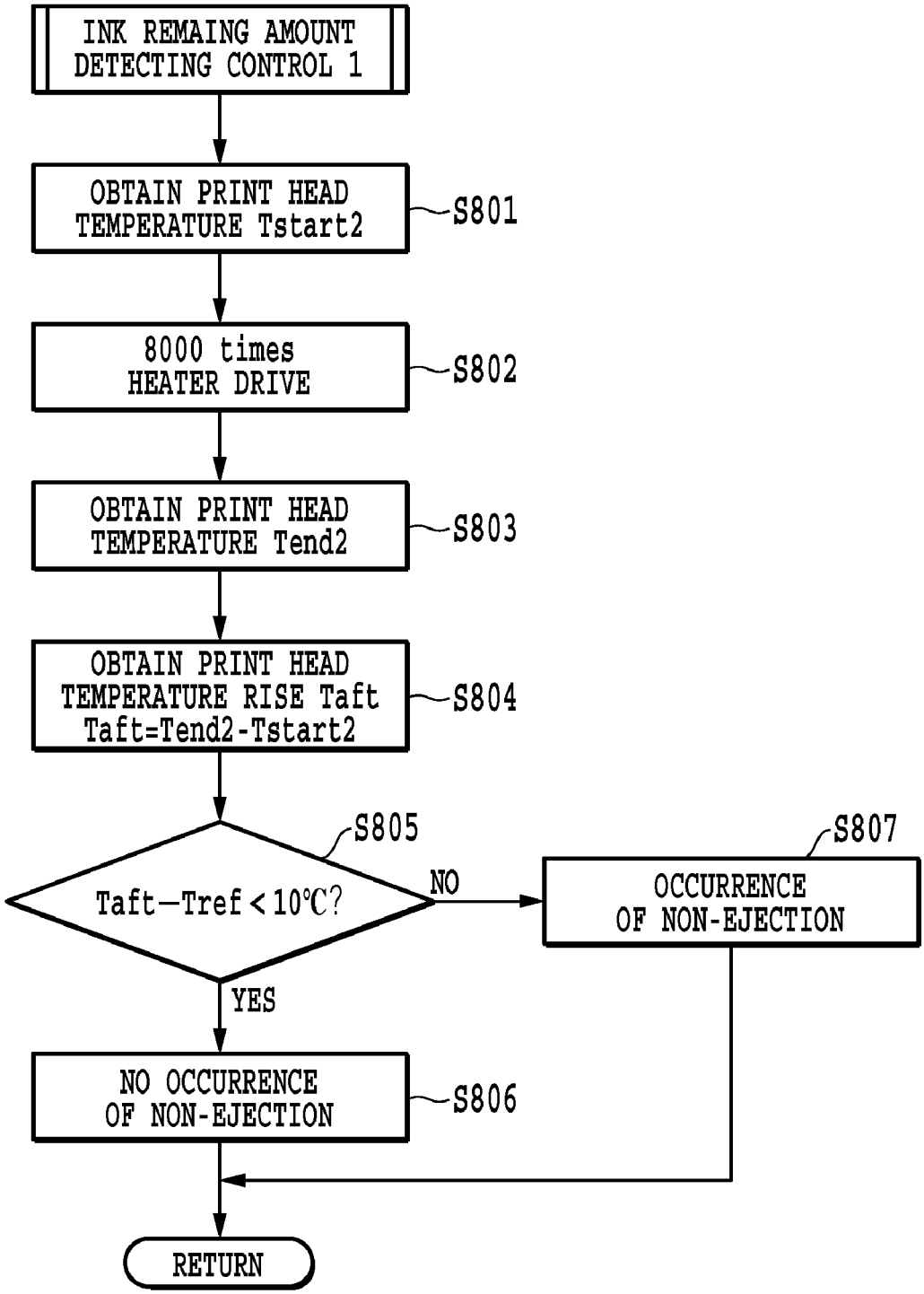
FIG. 8 is a flow chart showing a detail of control for detecting an ink remaining amount in the embodiment of the present invention.

FIG. 8 is a flow chart showing the procedure of the ink remaining amount detecting control 1 in the present embodiment. First, a print head temperature Tstart2 before driving the heater (energy generating element) is obtained (S801). Next, the heater (energy generating element) is driven in such a manner as to perform 8000 times of ink ejections in 15 kHz from all nozzles ejecting cyan ink in the print head 101 (S802). Next, a print head temperature Tend2 after completing 8000 times of the ink ejections is obtained (S803). Further, a temperature rise Taft due to the heater drive corresponding to 8000 times of the ink ejections is calculated from a difference between the print head temperature Tend2 after completing 8000 times of the ink ejections and the print head temperature Tstart2 before driving the heater (Taft=Tend2−Tstart2) (S804).

It is determined whether or not a value found by subtracting the print head temperature rise Tref obtained at step S606 of control for obtaining the print head temperature characteristic from the print head temperature Taft calculated bat step S804 is lower than a certain temperature (S805). In the present embodiment, this certain temperature is set as 10° C. In a case of detecting a state change of the print head (here, ink remaining amount), it can be determined that a clear state change occurs if the print head temperature including even a temperature detection error of the diode sensor 208 and the like changes by 10° C. Therefore, in the present embodiment, this certain temperature is set as 10° C.

Accordingly, in the present embodiment, in a case where the temperature of Taft−Tref is 10° C. or more, it is determined that non-ejection occurs during the printing of one page (S807), thereby completing the ink remaining amount detecting control 1. On the other hand, in a case where the temperature of Taft−Tref is less than 10° C., it is determined that the non-ejection does not occur during the printing of one page (S806), thereby completing the ink remaining amount detecting control 1.

By referring to the flow chart in FIG. 7 again, it is determined whether or not non-ejection occurs during the one-page printing which has been carried out at step S701, based upon the result of the ink remaining amount detecting control 1 (S706). In a case where it is determined that the non-ejection does not occur, it is determined whether or not data at the next page exist (S709). The process ends in a case where the print data do not exist. In a case where the print data exist, the process goes back to step S701, wherein the printing corresponding to the next one page is carried out.

On the other hand, in a case where it is determined that the non-ejection occurs during the printing of the one-page, a user is informed of absence of the ink through a host computer by a display (S707). Further, the print data at the present page printed are stored in the RAM (S708) to complete the printing.

Here, there will be described the reason for measuring a print head temperature in a case where the difference between the atmosphere temperature and the head temperature is less than 3° C. or in a case where the elapse time from the print completion is 20 sec or more in the control for obtaining the print head temperature characteristic and in the ink remaining amount detecting control of the present embodiment.

Figure 9:
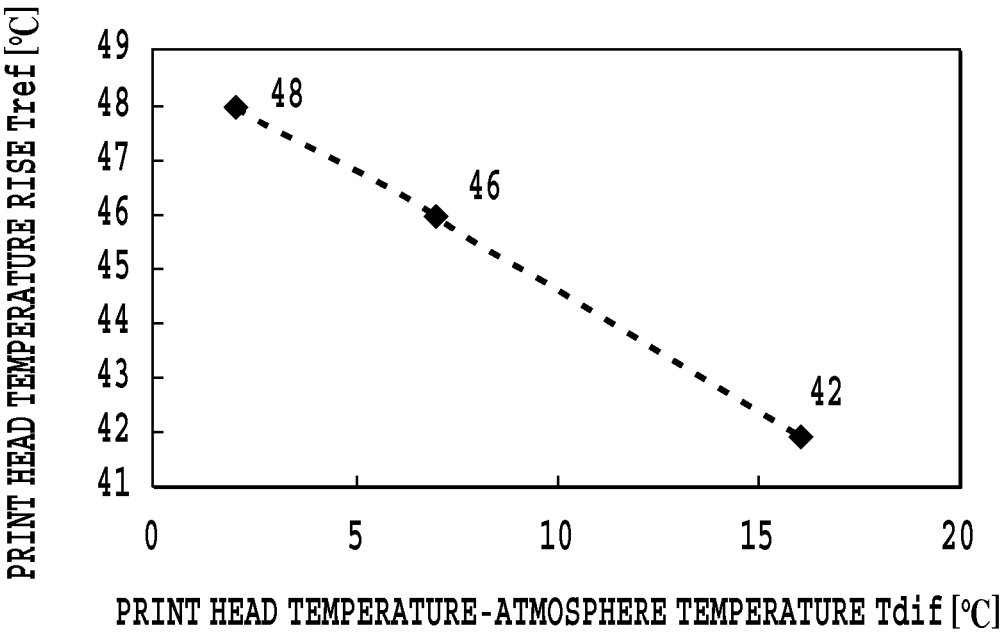
FIG. 9 is a graph showing a relation of a rise of a print head temperature and a difference between the print head temperature and an atmosphere temperature at the time of performing the control for obtaining the print head temperature characteristic in the embodiment of the present invention.

FIG. 9 shows a relation of the print head temperature rise Tref obtained by the control for obtaining the print head temperature characteristic and the difference Tdif between the print head temperature and the atmosphere temperature. The atmosphere temperature in FIG. 9 is 25° C. When the difference Tdif changes, the print head temperature rise Tref due to the heater drive corresponding to 8000 times of the ink ejections also changes.

Figure 10:
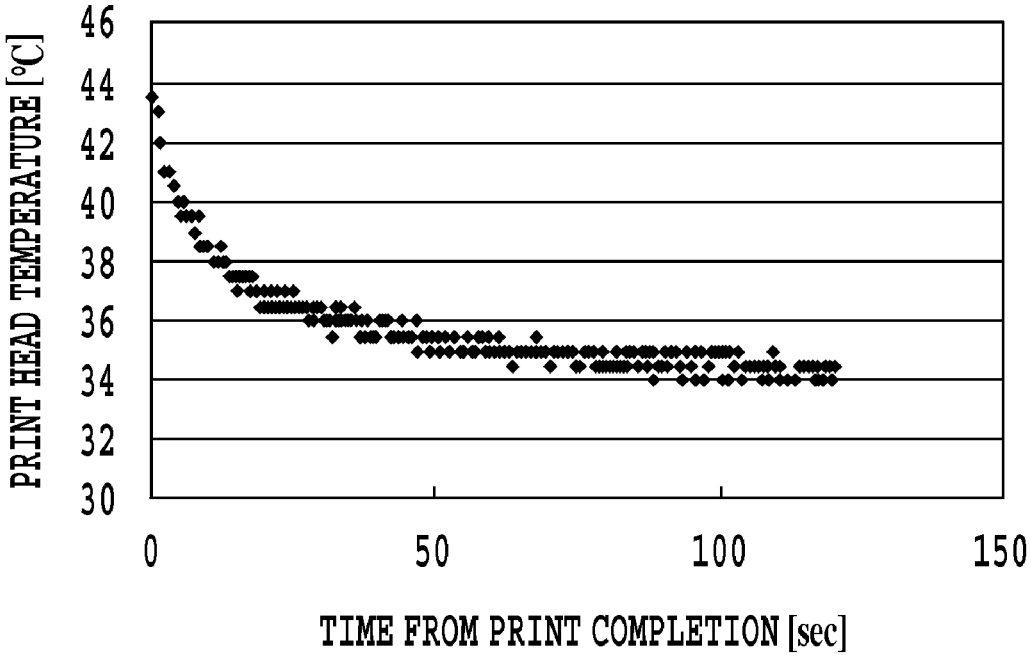
FIG. 10 is a graph showing a relation between a print head temperature and an elapse time after performing solid printing in the embodiment of the present invention.

FIG. 10 shows a relation between a print head temperature after carrying out solid printing on an entire region of one sheet of A4 by all nozzles of cyan ink and an elapse time from the print completion. The atmosphere temperature in FIG. 10 is 34.5° C. In general, the print head temperature increases from the atmosphere temperature as the number of times of ink ejections, that is, the number of times of the heater drive increases, and a difference between the print head temperature and the atmosphere temperature is maximized in a case of carrying out the solid printing over the entire region of a print paper. Further, as shown in FIG. 10, the print head temperature descends with an elapse time from the print completion and approaches the atmosphere temperature.

That is, in a case of obtaining the print head temperature characteristic immediately after performing the printing onto a medium, the difference between the atmosphere temperature and the print head temperature changes due to a pattern of the print data, and along with it, Tdif also changes. However, the difference between the atmosphere temperature and the print head temperature becomes smaller with an elapse time from the print completion onto the medium. Therefore, by controlling a difference between the atmosphere temperature and the heat start temperature to be less than a predetermined value as in the case of the present embodiment, it is possible to stabilize detection of the head temperature rise due to the heater drive. In the present embodiment, the difference between the atmosphere temperature and the print head temperature is set as 3° C. for not affecting 10° C. which is a determination criterion to the non-ejection in the ink remaining amount detecting control 1.

Figure 11:
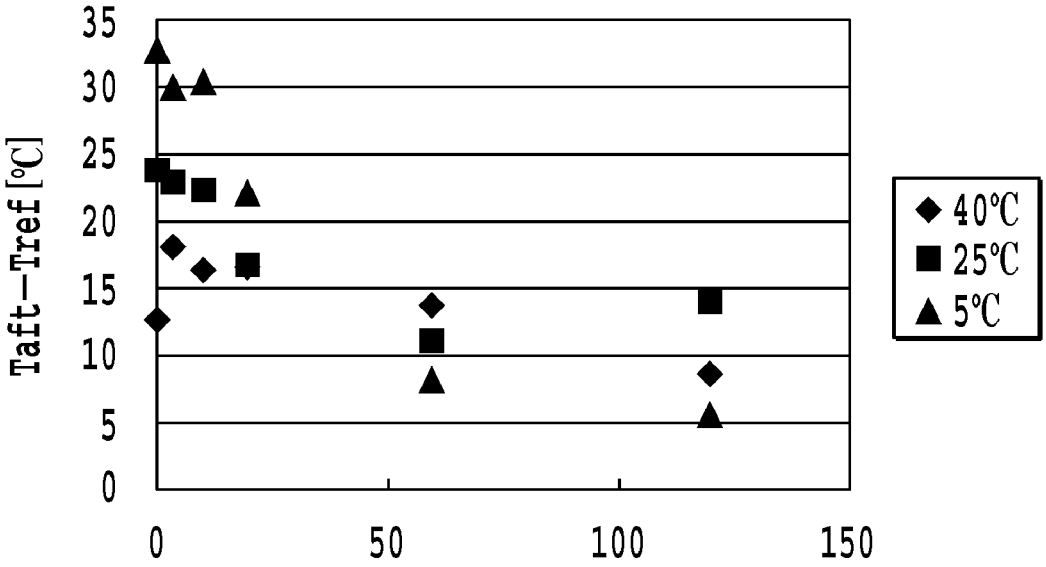
FIG. 11 is a diagram showing a relation between time from print completion to heat drive start and a calculation value Taft−Tref in the ink remaining amount detection in the embodiment of the present invention.

FIG. 11 is a diagram showing a relation between time from print completion to heat drive start and a calculation value Taft−Tref at the time of performing the ink remaining amount detecting control 1 after non-ejection occurs at one-page printing in the ink remaining amount detection. The abscissa axis shows the time from print completion to heat drive start and the ordinate axis shows calculation values Taft-Tref in a case where the atmosphere temperatures are 40° C., 25° C., and 5° C. In FIG. 11, even in a case where the non-ejection occurs during the printing, as the time from the print completion to the heat drive start becomes long, a temperature of Taft-Tref is 10° C. or less. In this case, it leads to the result of being incapable of determining the non-ejection regardless of occurrence of the non-ejection. This is because since the head which could not eject during the printing becomes in a state of being capable of ejecting with time, the print head temperature rise is lower than at the non-ejection time, and therefore, the difference between the print head temperature rise Taft and the print head temperature rise Tref stored by the control for obtaining the print head temperature characteristic is reduced.

The ink mounted in the inkjet printing apparatus is usually held by a negative pressure generating member in the ink tank, such as an absorption element so that the ink does not spill out of the ejection opening at a non-ejection time. That is, a pressure (negative pressure) is applied to the ink so that the ink is pulled to the ink tank side. When the ink in the ink tank is reduced by performing the printing, since only the ink amount reduces without a change of the holding force, the negative pressure gradually increases. In addition, since the ejection is performed in a high frequency of 15 kHz, the negative pressure is also generated by the ejection. Since the ink is pulled strongly to the tank side due to an increase of the negative pressure by reduction of the ink and by the ejection, bubbles are generated in an ink flow passage 206 positioned between the print head chip 207 and the ink absorption element 205 as the negative pressure generating member. When the ejection further continues to be performed in this state, the bubble develops to be large and also reaches the nozzle in the print head chip 207. Thereby, the ink supply to the ejection opening is impossible, and as a result, although the ink still remains in the ink tank, the ink ejection can not be performed. When the ejection is stopped, the dynamic negative pressure generated due to the ejection disappears and the bubble reduces or moves to the side of the ink absorption element 205. In consequence, the ink is supplied to the nozzle opening to enable the ejection again. Therefore, when the heater drive is performed in a predetermined time after the printing is completed, the ejection is again possible. However, since a remaining amount of the ink is small, when the ejection is performed for a little while, the ejection becomes again in a state incapable of being performed.

That is, when the time from the print completion to the heat start is long in the ink remaining amount detection, the non-ejection does not occur during the performing of 8000 times of the ink ejections and therefore, there is a possibility of being incapable of detecting the non-ejection during printing. Therefore, even in a case where a difference between the atmosphere temperature and the heat start temperature is not less than a predetermined value, in a case where a predetermined time elapses in a period from the print completion to the heat start, an ink remaining amount detection is designed o be performed. In this way, the predetermined time is defined as 20 sec. The time from the print completion to the heat start is thus controlled in the present embodiment, and thereby, it is possible to further accurately and stably detect the non-ejection during printing.

As described above, in the ink remaining amount detection for detecting a determination as to whether or not printing is performed without non-ejection after the printing is completed, based upon a print head temperature change after driving the energy generating element, even in a case where the head temperature rises due to the printing, it is possible to accurately detect an ink remaining amount.

It should be noted that in the present embodiment, a print unit of the next print is set as one page, but the present invention is not limited to this, that is, in a case where the print unit is a few-scan unit or a few-page unit, an ink remaining amount set for enabling the print may be changed to an optimal amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-066476, filed Mar. 14, 2008, which is hereby incorporated by reference herein in its entirety.

What is claimed is:

1. An inkjet printing apparatus, comprising:

a print head including an energy generating element generating energy used for ejecting ink from an ejection opening;

a print head temperature detecting unit that detects a temperature of the print head before and after driving the energy generating element;

an atmosphere temperature detecting unit that detects an atmosphere temperature of the printing apparatus;

a predicting unit that predicts an ink amount of the print head based on the print head temperature detected before and after driving the energy generating element; and a prohibiting unit that prohibits the predicting unit from predicting the ink amount when the temperature of the print head is higher than an atmosphere temperature detected by the atmosphere temperature detecting unit by a predetermined amount.

2. A predicting method of predicting an ink amount of an inkjet printing apparatus having a print head including an energy generating element generating energy used for ejecting ink from an ejection opening, comprising:

a print head temperature detecting step for detecting a temperature of the print head before and after driving the energy generating element;

an atmosphere temperature detecting step for detecting an atmosphere temperature of the printing apparatus;

a predicting step for predicting an ink amount of the print head based on the temperature of the print head detected before and after driving the energy generating element; and a prohibiting step for prohibiting the predicting step from predicting the ink amount when the temperature of the print head is higher than an atmospheric temperature by a predetermined amount.

3. An inkjet printing apparatus according to claim 1, wherein the prohibiting unit does not prohibit the predicting unit from performing the prediction in a case where a predetermined time has passed after printing by the print head has finished.

4. A method according to claim 2, wherein the prohibiting step does not prohibit the predicting step from performing the prediction in a case where a predetermined time has passed after printing by the print head has finished.

* * * * *